United States Patent [19]

Klem et al.

[11] 4,297,914

[45] Nov. 3, 1981

[54] CONTROL LEVER GATE WITH LEVER RESTRAINT

[75] Inventors: John E. Klem, Waukegan; Daniel E. Nelson, Wildwood, both of Ill.

[73] Assignee: International Harvester Company, Chicago, Ill.

[21] Appl. No.: 148,632

[22] Filed: May 12, 1980

[51] Int. Cl.[3] ..... G05G 5/06

[52] U.S. Cl. ..... 74/532; 74/475; 70/201

[58] Field of Search ..... 74/475, 526, 527, 532; 70/192, 193, 199, 202, 238

[56] References Cited

U.S. PATENT DOCUMENTS 2,246,919 6/1941 Krantz ..... 74/532

4,077,276 3/1978 Knox, Jr. ..... 74/475

FOREIGN PATENT DOCUMENTS 81417 3/1953 Norway ..... 74/527

*Primary Examiner*—Kenneth Dorner

*Attorney, Agent, or Firm*—Douglas W. Rudy; F. David AuBuchon

[57] ABSTRACT

A shift gate 22 allowing movement of a control lever 12 in a fore and aft plane is provided with a pivotable plate 46 having a recess 60 located in the midsection of said pivotable plate corresponding to a neutral position of a control lever. The control lever 12 will be locked in neutral when the pivotable plate is swung into position and an attached security knob 56 draws the pivotable plate 46 into a restrained position.

7 Claims, 6 Drawing Figures

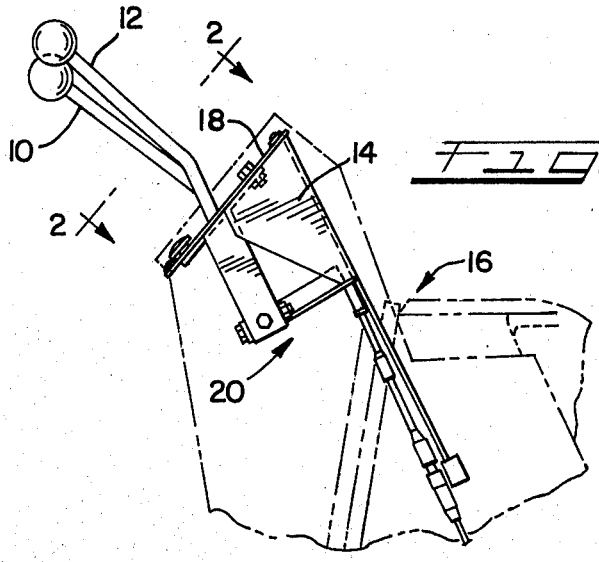
FIG. 1
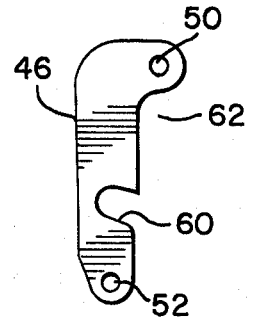
FIG. 3
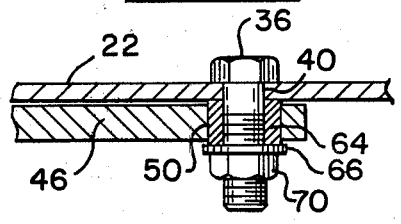
FIG. 2
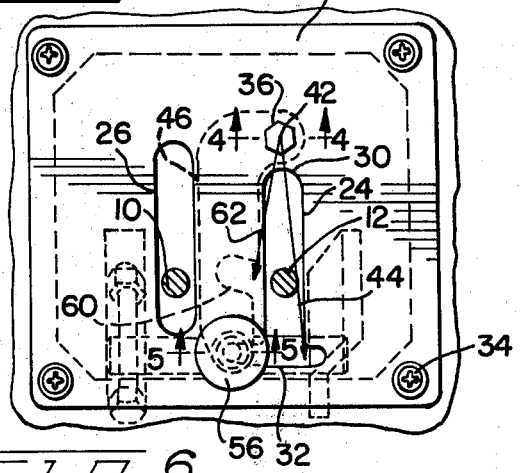
FIG. 4
FIG. 5
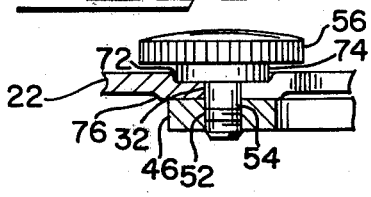
FIG. 6
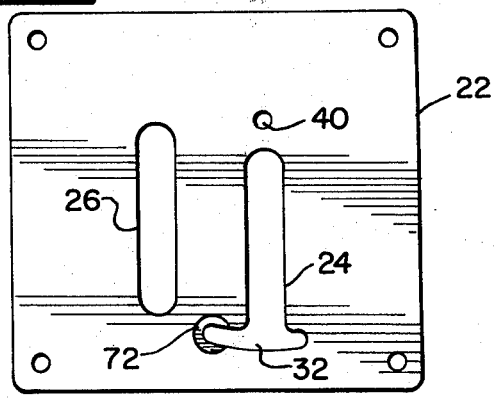

CONTROL LEVER GATE WITH LEVER RESTRAINT

BACKGROUND OF THE INVENTION

This invention concerns shift gates on motor vehicles. More particularly, a shift gate is provided that incorporates apparatus enabling a directional control lever to be trapped in a neutral position in a positive manner so as to prevent movement of the control lever without active released by the machine operator.

Shift gates are well known in the prior art. The gate itself is usually a plate provided with a variety of paths through which a control lever may be moved. Often the lever is provided with detented positions that require some input force on the control lever to disengage the lever from the detented position. On more sophisticated shift gates it is common to see a positive lockout device that is provided to prevent the inadvertent movement of a control lever into a lesser used or normally not used gear such as reverse gear on an automobile. These lockouts often are automatically engaged and manually disengaged.

In the construction equipment vehicle field, it is common to see a flip-over type neutral restraining device designed to prevent a control lever from being moved out of neutral when the vehicle is not being driven in forward or reverse. A typical device will incorporate a hinged plate having a U-shaped cutout arranged at right angles to the hinge pivot point. When the operator wishes to lock a control lever in neutral the U-shaped bracket is flipped over so that the control lever is in the cutout and cannot be moved in a fore and aft plane. One disadvantage of this typical device is that it is usually only held in place by gravity (or a weak spring) hence will be a noise generator, both in the engaged and disengaged position. Also it is possible that it can be vibrated out of engagement if the vehicle is subjected to a violent jostling. This could lead to disasterous results if, for instance, the device became disengaged as the vehicle is being towed and the control lever slipped into gear. The lever restraint provided by this invention is designed to positively lock the control lever in neutral and to minimize the chances of it being inadvertently disengaged.

The prior art also knows of position restraining tightening knobs such as are used in this invention. These knobs are usually used where a limit is imposed on the range of movement of a control rod. The knob is moved along a restraining slot until it is at the desired position and then the knob is tightened and thus provides the lever limit stop. A typical use is found in the position control lever of an agricultural tractor so that the farmer can move a plow depth control lever to a fully raised position when he prepares to make a headland turn with the plow out of the ground, then when the farmer gets the tractor turned around, he simply moves the lever to the stop position and thus will be assured of equal depth plowing from row to row.

This invention uses the knob to provide an easy method of tool-free locking of a pivotable plate in either an engaged or disengaged position. In a disengaged position, a knurled security knob is tightened down to hold the pivotable plate out of engagement with the directional control lever. Also in an engaged position, the security knob is tightened down to hold the directional control rod in a neutral position.

It is amongst the objects of this invention to provide a control lever restraining device that can be maintained in either a disengaged or an engaged position and can be easily moved to an opposite position.

It is also an object of this invention to provide a lever restraint that will have a tendency to be self-engaging upon malfunction of a security knob.

An advantage of this lever restraint is that it is compact enough to be positioned between adjacent levers in a multiple lever embodiment. Furthermore, the device is relatively inexpensive and easy to manufacture.

A great advantage is that the lever restraint will securely control a control lever position when the device is properly secured and conversely will not interupt the lever operation when restraint is not desired.

SUMMARY OF THE INVENTION

In a construction equipment vehicle where there is a control lever for controlling the fore and aft vehicle direction, a neutral maintaining lever restraint is provided. A rigid cover plate acts as a lever gate to which a pivotable plate is attached. The pivotable plate is provided with a trap slot into which the control lever is directed corresponding to neutral position of the lever. A security knob is provided to maintain a pivotable plate in a position either engaging the control lever or in a disengaged position wherein the control lever is free to move.

BRIEF DESCRIPTION OF THE DRAWING FIGURES

The objects and advantages of this invention will be realized upon an understanding of the drawing figures in light of this specification wherein:

FIG. 1 is a side elevation view of a console incorporating the invention;

FIG. 2 is a top view of the invention;

FIG. 3 is a top view of the pivotable plate of the invention;

FIG. 4 is an elevation view of the pivot point and pivotable plate attaching device;

FIG. 5 is an elevation view of the security knob of the invention and its relationship to the cover plate and the pivotable plate; and FIG. 6 is a top view of the cover plate of the invention.

DETAILED DESCRIPTION OF THE DRAWING FIGURES

FIG. 1 presents the typical environment in which this control lever restraint would be utilized. The drawing shows a transmission range control lever 10 and a vehicle direction control lever 12 mounted next to it in a console 14 of a front end loader type of mobile construction equipment generally 16. Each control lever would coact with a linkage system such as that shown generally as 20. Interest herein will be directed to a restraint of the direction control lever 12 as accidental engagement of either forward or reverse when only neutral is desired is of interest with this invention. It should be noted that the surface 18 of the console 14 is angled steeply from the horizontal.

FIGS. 2, 3 and 4 more distinctly set forth the detailed components of the invention. In these figures, the shift gate is comprised of a rigid cover plate 22 having a first elongated slot 24 machined therethrough as well as a second elongated slot 26. The first elongated slot 24 provides access for the vehicle direction control lever 12 while the transmission range control lever 10 passes through slot 26.

The first elongated slot 24 has an arcuate end 30 corresponding generally to the position the lever 12 would be in when the lever is urged to a forward direction of travel position. The lower end of the first elongated slot 24 as viewed in FIG. 2 is provided with a transverse arcuate slot 32 that extends leftwardly and rightwardly from the first elongated slot 24. When the direction control lever 12 is at the lower end of slot 24, generally where the centerline of slot 24 and the centerline of the transverse arcuate slot 32 intersect, the lever will be in a position allowing reverse direction of vehicle travel.

The rigid cover plate 22 may be fastened to the console by screw type fasteners such as 34.

A bolt 36 is positioned through a hole 40 and defines an axial center point 42. The centerline of transverse arcuate slot 32 is on a constant radius as defined by long radius 44.

The bolt 36 acts as the mounting means for the pivotable plate 46 which is shown in broken lines hidden behind the rigid cover plate 22 and is also shown in FIG. 3 unattached to the rigid cover plate. The pivotable plate 46 is of a generally inverted "L" shape provided with an upper aperture 52 for accommodating bolt 36 and a lower threaded aperture 52 for accommodating the stud 54 of the security knob 56 as best seen in FIG. 5. In the mid-section of the long leg of the pivotable plate a trap slot 60 is provided. This trap slot 60 is the recess in which the control lever 12 will be trapped when the pivotable plate 46 is rotated around the axial center point 42 provided by bolt 36 when the control lever 12 is in neutral. The trap slot 60 arc follows a radius 62 drawn from the axial center point 42 so that the pivotable plate 46 can be swung into position blocking forward or rearward deployment of the control lever 12.

FIG. 4 shows the bolt 36 passing through hole 40 of the rigid cover plate 22. A bushing 64 is fitted to the upper aperture 50 of the pivotable plate 46 and is slightly thicker than the plate 46 to prevent the pivotable plate from binding against the adjacent inside surface of the rigid cover plate 22. A washer 66 and nut 70 are threaded onto the bolt 36 to hold the pivotable plate 46 in place.

FIG. 5 shows the security knob 56 having a milled edge to assist in finger gripping. The security knob 56 includes the stud 54 which passes through the transverse arcuate slot 32 into the threaded aperture 52 of the pivotable plate 46. A significant feature of the invention that is shown in this view is the circular depression 72 in the rigid cover plate 22. The circular depression 72 is sized to accommodate a pedestal portion 74 of the security knob 56. The depression will serve to locate the appropriate position of the security knob when the lever restraint is in a disengaged position.

In the forming of the circular depression 72 a raised plateau 76 is formed on the obverse side or the back side of the rigid cover plate 22 which allows the pivotable plate 46 to be carried a slight distance away from the obverse surface of the cover plate 22 for most of its length when the pivotable plate is in a disengaged position.

FIG. 6 shows the rigid cover plate 22 by itself and the depression 72 is clearly seen at the left end of the transverse arcuate slot 32.

To restrain the control lever 12 the operator will unscrew the security knob 56 sufficiently far to enable it to be lifted out of the circular depression 72. He then puts the control lever 12 in neutral and swings the pivotable plate 46 counter clockwise so that the stud 54 of the security knob moves through the transverse arcuate slot 32 until the stud comes to the end of the slot 32. The control lever 12 is now in the trap slot 60 and cannot be moved to the forward or reverse position. The operator then tightens the security knob 56 to hold the pivotable plate in position.

One aspect of the invention that assists in its function is that the pivotable plate 46 will, through the force of gravity, swing to a position such that the control lever will be in the trap slot when the security knob is too loose to hold the pivotable plate at the right end of the transverse arcuate slot. Of course, the surface of the console 18 has to be non-horizontal as shown in FIG. 1.

Thus it is apparent that there has been provided a control lever gate with a lever restraint that satisfies the objects, aims and advantages of this invention. Although a single preferred embodiment has been shown in the drawing figures, it is expected that modifications apparent from the specification would be possible without exceeding the scope of this invention. For instance, it would be highly likely that a plurality of lever restraining mechanisms be incorporated in a single control lever gate and thus, such variations should be considered within the scope of this invention.

What is claimed is:

1. In a vehicle having a control lever capable of being moved in fore and aft directions and including a neutral location, a lever restraint for restraining said control lever in said neutral position comprising:

a rigid cover plate provided with an elongated slot for accommodating said control lever in the range of said control lever fore and aft directions, a transverse arcuate slot at an end of said elongated slot, a bore through said rigid cover plate located adjacent said slot at the upper end thereof opposite said transverse arcuate slot;

a bolt and nut fastener positioned in said bore of said rigid cover plate defining an arcuate center point;

a pivotable plate pivotally attached to the back side of said rigid cover plate by said bolt and nut fastener, said pivotable plate being generally "L" shaped and provided with an upper aperture in an end of a short leg of said "L" shape and a threaded lower aperture in the end of a long leg of said "L" shape, and a trap slot in a mid-section of said long leg of said "L" shape pivotable plate;

a bushing carried in said upper aperture of said pivotable plate, said bushing having a length greater than the width of said pivotable plate;

a security knob having a threaded stud passing through said rigid cover plate and threaded into said threaded lower aperture of said pivotable plate whereby said pivotable plate may be pivoted around said bolt and said control lever, when in the neutral position, will be trapped in said trap slot of said pivotable plate and whereby tightening of said security knob will prevent movement of said pivotable plate.

2. The invention in accordance with claim 1, wherein said rigid cover plate is provided with a circular depression at one end of said transverse arcuate slot defining a disengaged position of said pivotable plate.

3. The invention in accordance with claim 2, wherein said security knob is provided with a pedestal portion having a diameter slightly smaller than said circular depression whereby said pedestal portion will be accommodated in said circular depression when said pivotable plate is in a disengaged position.

4. The invention in accordance with claim 2, wherein said rigid cover plate is provided with a raised plateau on the back side thereof obverse to said circular depression.

5. The invention in accordance with claim 4, wherein said pivotable plate will contact the back side of said rigid cover plate only at said raised plateau.

6. The invention in accordance with claim 1, wherein said rigid cover plate is mounted to a console at a non-horizontal angle with said bolt vertically elevated above said security knob whereby said pivotable plate will rotate toward said elongated slot when said security knob is released.

7. The invention in accordance with claim 1, wherein said rigid cover plate is provided with a second elongated slot adjacent said first elongated slot.

* * * * *